US008287116B2

(12) United States Patent
Cofler

(10) Patent No.: US 8,287,116 B2
(45) Date of Patent: Oct. 16, 2012

(54) PRINTING APPARATUS AND METHOD

(75) Inventor: Marian Cofler, Lod (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 710 days.

(21) Appl. No.: 12/371,172

(22) Filed: Feb. 13, 2009

(65) Prior Publication Data

US 2009/0207224 A1 Aug. 20, 2009

Related U.S. Application Data

(60) Provisional application No. 61/028,541, filed on Feb. 14, 2008, provisional application No. 61/032,094, filed on Feb. 28, 2008.

(51) Int. Cl.
*B41J 2/01* (2006.01)

(52) U.S. Cl. ..... 347/102; 347/101

(58) Field of Classification Search ..... None
See application file for complete search history.

(56) References Cited

U.S. PATENT DOCUMENTS

| | | | | |
|---|---|---|---|---|
| 6,000,793 | A * | 12/1999 | Inamoto | 347/101 |
| 6,877,853 | B2 * | 4/2005 | Kiguchi et al. | 347/102 |
| 7,387,352 | B2 * | 6/2008 | Florence et al. | 347/9 |
| 7,419,257 | B2 * | 9/2008 | Mouri et al. | 347/103 |
| 7,520,601 | B2 * | 4/2009 | Claes et al. | 347/102 |
| 7,758,178 | B2 * | 7/2010 | Saitoh et al. | 347/102 |
| 2001/0038408 | A1 * | 11/2001 | Codos et al. | 347/102 |
| 2003/0011670 | A1 * | 1/2003 | Shirakawa | 347/102 |
| 2003/0189609 | A1 * | 10/2003 | Ishikawa | 347/11 |
| 2003/0222962 | A1 * | 12/2003 | Hirai | 347/102 |
| 2005/0168555 | A1 * | 8/2005 | Niekawa | 347/102 |
| 2007/0109382 | A1 * | 5/2007 | Lafleche et al. | 347/102 |
| 2008/0192100 | A1 * | 8/2008 | Nakajima | 347/102 |

FOREIGN PATENT DOCUMENTS

| | | |
|---|---|---|
| WO | WO-2005/100037 | 10/2005 |
| WO | WO-2007/090040 | 8/2007 |

OTHER PUBLICATIONS

"Printing or Coating Apparatus and Method," U.S. Patent Application (Unassigned) Filed Concurrently Herewith.

* cited by examiner

*Primary Examiner* — Stephen Meier
*Assistant Examiner* — Leonard S Liang

(57) ABSTRACT

A printing apparatus for printing on a substrate comprises a first support for the substrate and a second support moveable relative to the first support. The second support supports an inkjet print head and at least one plasma source. The print head and plasma source move with the support to apply plasma to the substrate and to deposit ink on the substrate treated with the plasma.

17 Claims, 10 Drawing Sheets

PRINTING APPARATUS AND METHOD

This application claims the benefit of U.S. provisional application Ser. Nos. 61/028,541, filed Feb. 14, 2008 and 61/032,094 filed Feb. 28, 2008. The entire contents of the aforementioned applications are incorporated herein by reference.

TECHNICAL FIELD

The present invention relates to a printing apparatus and to a printing method.

BACKGROUND

Inkjet printing is widely used for printing of billboards, banners and point of sale displays. The ink-jet printing process involves manipulation of drops of ink ejected from an orifice or a number of orifices of a print head onto an adjacent print substrate. Paper, vinyl, textiles, fabrics, and others are examples of print substrates. Relative movement between the substrate and the print head enables substrate coverage and image creation. A number of platens forming so-called substrate feed path carries out substrate transportation. Alternatively, the substrate may be located on a moving support usually termed flat bed support and moved together with the support. The print head typically reciprocates over the recording substrate ejecting ink droplets forming a section of an image or a swath at each path. After each reciprocating movement or pass, the substrate is further transported to a position where the next section of a desired image may be printed on it.

In order to ensure print quality and enable print handling the ink should adhere to the surface on which printing is performed. Adhesion is typically improved by proper surface treatment, which may be a chemical treatment, a corona treatment or other known types of surface treatment. Printed ink should be dried or cured. Although a large proportion of printing is performed by solvent based inks, curable inks are becoming popular since they generate a light and waterproof image characterized by vivid colors. A large proportion of printing is done with solvent-based inks, which generally are of lower cost than curable inks.

There is a growing demand for printers printing on a variety of substrates including substrates characterized by poor adhesion such as polypropylene, polystyrene, polycarbonate, and similar. In order to enable printing with solvent or UV curable inks on a variety of substrates, it is necessary either to provide the printing surface with improved wettability and adhesion properties or to use ink capable of firm adhesion to a variety of substrates.

Therefore, there is a need to provide a method of, and apparatus for, printing enabling firm ink to substrate adhesion free of the above drawbacks.

The apparatus and the method are particularly pointed out and distinctly claimed in the concluding portion of the specification.

BRIEF DESCRIPTION OF THE DRAWINGS

For a better understanding of the invention, reference will now be made by way of example to the accompanying drawings, in which.

DETAILED DESCRIPTION OF THE EXEMPLARY EMBODIMENTS

Figure 1A:
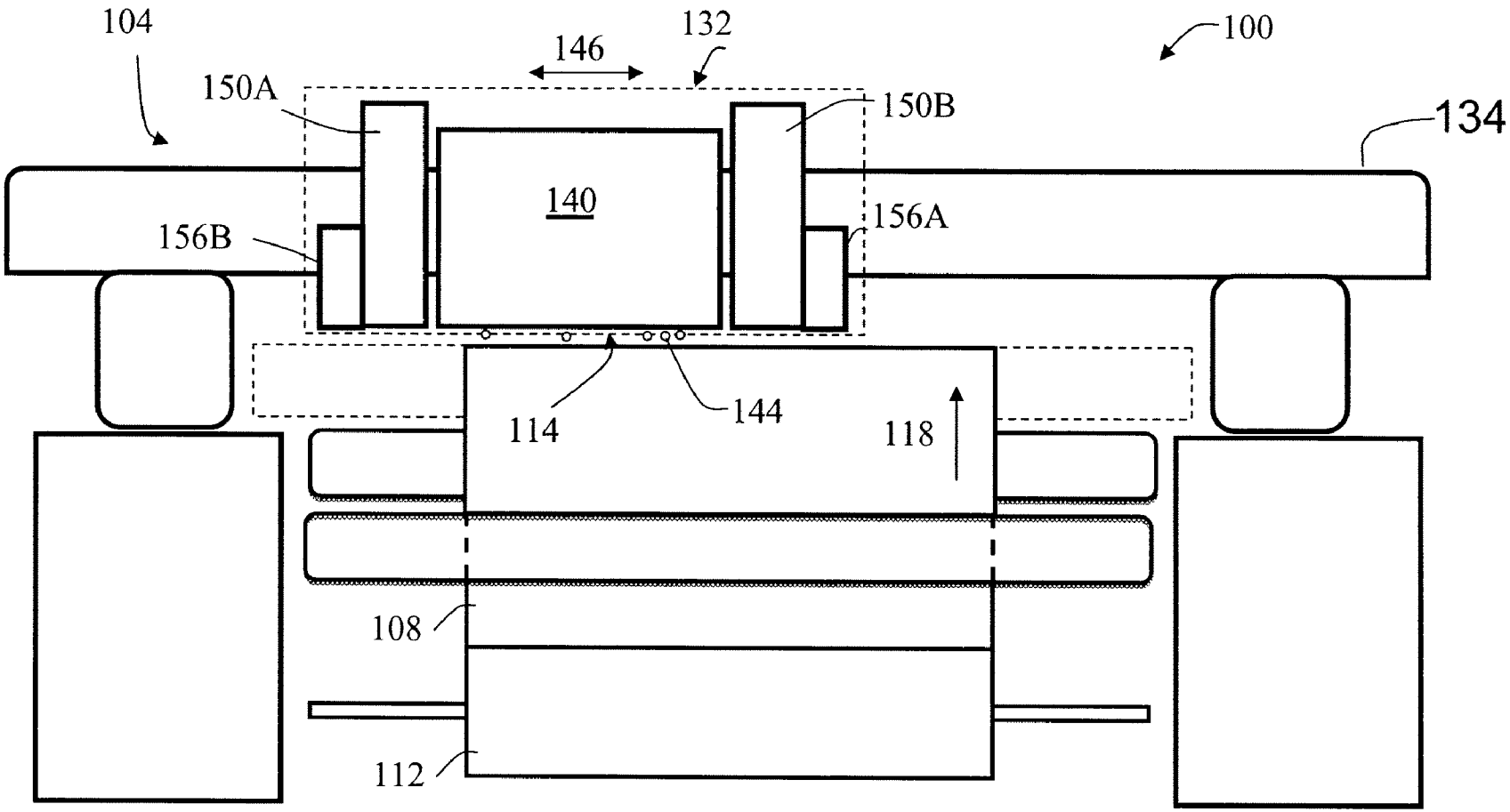
FIGS. 1A-1C are schematic illustrations of some exemplary embodiments of an inkjet printer operating with a plasma substrate treatment unit.
Figure 1B:
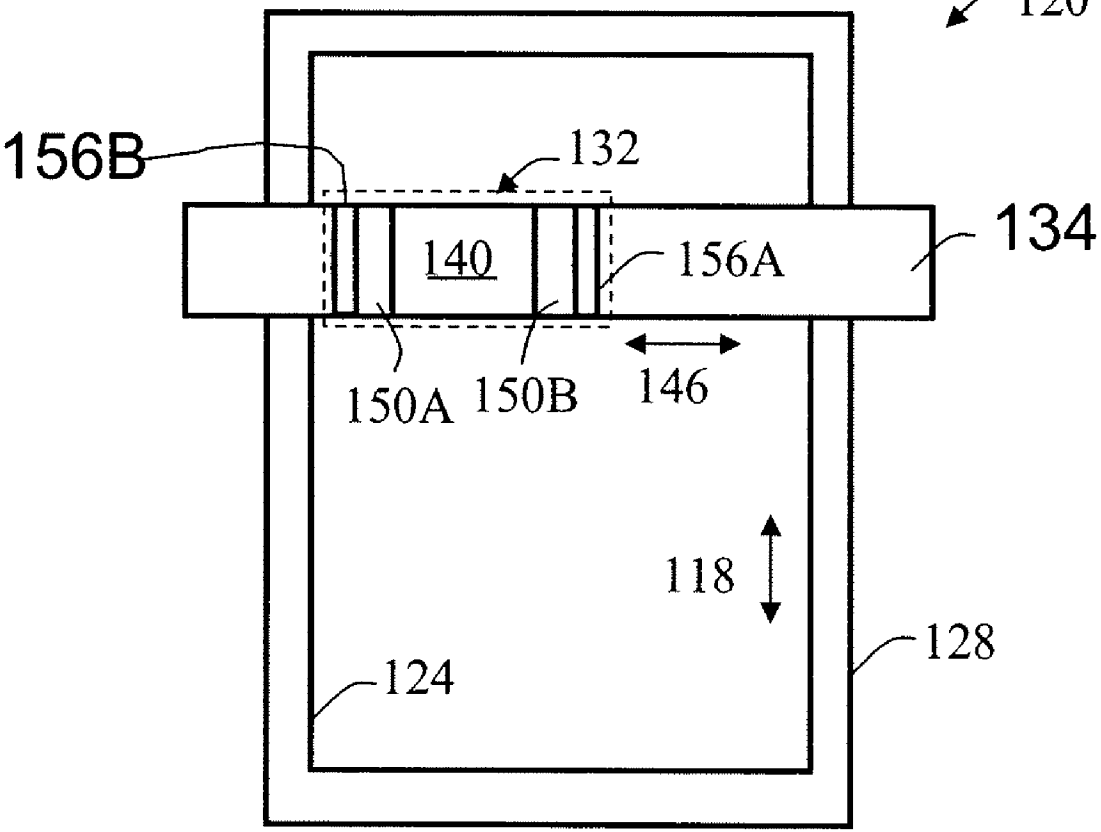
Figure 1C:
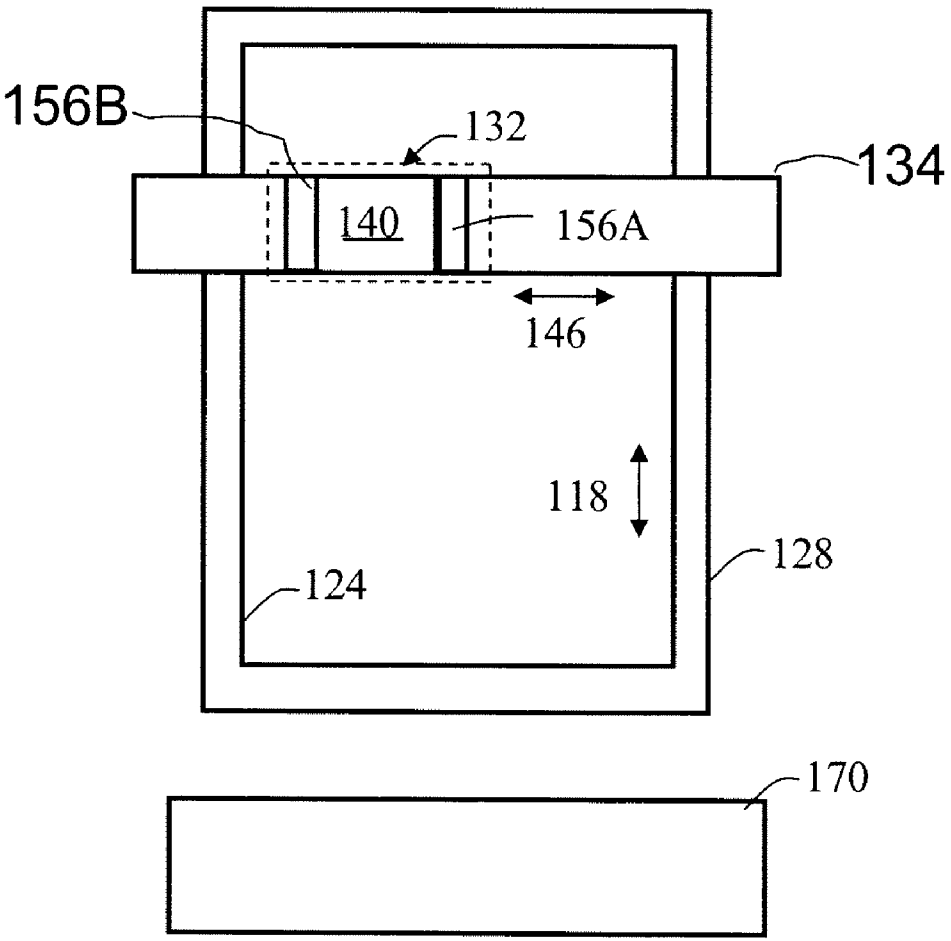

Reference is made to FIGS. 1A, 1B and 1C, which are schematic illustrations of examples of inkjet printers operating with a plasma substrate treatment.

Referring to FIG. 1A, a printer 100 is a wide format printer for printing on wide flexible substrate. Printer 100 may be of any known type such as for example, a roll-to-roll printer 104 as shown in FIG. 1A that typically pulls a flexible printing substrate 108 from a supply roll 112 over a substrate support area to a receiving roll (not shown) in a direction indicated by arrow 118. The printer 100 has a carriage 132 supported by a support 134 for movement in a direction 146 transverse to the direction of movement 118 of the substrate. The carriage 132 has an inkjet printing head 140 for depositing ink droplets 144 on the substrate. The carriage 132 reciprocates over the substrate in the direction 146 typically orthogonal to the direction 118 of movement of the substrate 108. These two orthogonal movements allow ink droplet deposition at every location of the substrate.

Referring to FIG. 1B, the printer is a flat bed printer 120 (FIG. 1B), where substrate, such as rigid substrate 124, is supported by a table or bed 128 of the printer and travels with it in the direction indicated by arrow 118. The printer 120 has a carriage 132 supported by a support 134 for movement in a direction 146 transverse to the direction of movement 118 of the substrate. The carriage 132 has an inkjet printing head 140 for depositing, from bottom portion 114, ink droplets 144 on the substrate. The carriage 132 reciprocates over the substrate in the direction 146 typically orthogonal to the direction 118 of movement of the substrate 108. These two orthogonal movements allow ink droplet deposition at every location of the substrate.

In an alternative arrangement, the substrate is static and the carriage moves in two directions. An example of such a printer is the HP 6500 printer. Also a printer may be capable of printing on both flexible and rigid substrates: an example of such a printer is the Espedio printer commercially available from Nur Macroprinters, Lod, Israel.

The printers 100 and 120 of FIGS. 1A and 1B are for use with UV curable ink and comprise one or more ultraviolet (UV) sources 150 for curing the ink, and one or more plasma sources 156. In one embodiment, at least one UV source 150 and at least one source of plasma 156 are coupled to carriage 132. The coupling may be rigid fixing the distance between carriage 132 and ultraviolet energy source 150, and source of plasma 156 or adjustable allowing for adjustment of the distance between carriage and the ultraviolet energy and plasma sources. In both cases movement of the UV sources 150 and plasma sources 156 is synchronized with movement of the carriage 132.

In another embodiment, UV sources 150 and plasma sources 156 are coupled directly to the print head 140. The coupling may be rigid fixing the distance between ultraviolet energy source 150 and print head 140 and source of plasma 156 or adjustable allowing for change of the distance between the print head and the ultraviolet energy and plasma sources.

In the examples of FIGS. 1A and B, the print head 140 is between first 150A and second 150B UV sources and the UV sources and the print head are between first 156A and second 156B plasma sources. The UV sources and the plasma sources are arranged so that as the carriage reciprocates right wards the first plasma source 156A, which leads the print head, treats the substrate 108 with plasma before the print head deposits ink and the first UV source 150A, which trails the print head, then cures the deposited ink. When the carriage moves leftwards the second plasma source 156B, which leads the print head, treats the substrate 108 with plasma before the print head deposits ink and the second UV source 150B, which trails the print head, then cures the deposited ink. In an embodiment, the plasma sources 156A and 156B operate continuously and, as the carriage reciprocates, the leading plasma source pre-treats the substrate and the trailing plasma source post-treats the substrate and the deposited ink.

FIG. 1C illustrates a printer for printing with other than UV curable inks. Such inks may be solvent based or water based inks. These inks should be dried upon deposition on the substrate 124. As illustrated plasma sources 156A and B are connected to print head 140 or carriage 132. In an embodiment, the plasma sources 156A and 156B operate continuously and, as the carriage reciprocates, the leading plasma source pre-treats the substrate and the trailing plasma source post-treats the substrate and the deposited ink. A drying device 170 is located away from the carriage in this example. It is operated at a later stage for example, when the substrate 108 or 124 is leaving the printing zone or even is removed from bed 128. (The printing zone is the space over which printing takes place.) The drying device may be carried by the carriage in an alternative embodiment.

Figure 2:
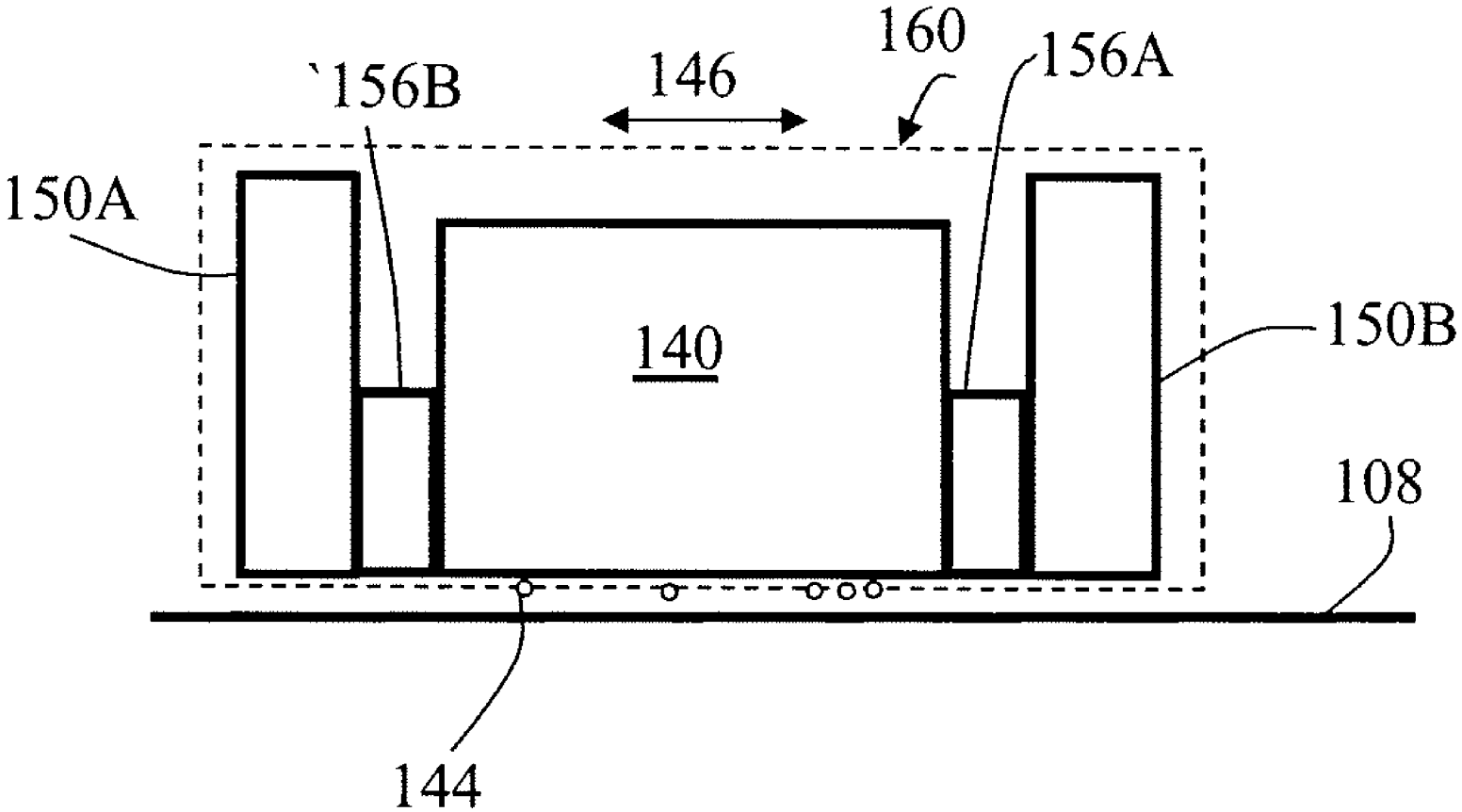
FIG. 2 is a schematic illustration of a carriage of another exemplary embodiment of an inkjet printer operating with a plasma substrate treatment unit.

FIG. 2 is a schematic illustration of another exemplary embodiment of a carriage block 160 for use in an inkjet printer operating with a plasma substrate treatment unit. It may be used in the printer of FIG. 1A or B. Carriage block 160 includes at least one inkjet print head 140 with UV radiation curing sources 150A and 150B located on respective sides of print head 140. Plasma sources 156A and 156B are located between print head 140 and UV sources 150. In an embodiment, the plasma sources 156A and 156B operate continuously and, as the carriage reciprocates, the leading plasma source pre-treats the substrate and the trailing plasma source post-treats the substrate and the deposited ink. The coupling between print head 140, plasma sources 156, and UV radiation curing sources 150 may be rigid or adjustable.

Figure 3:
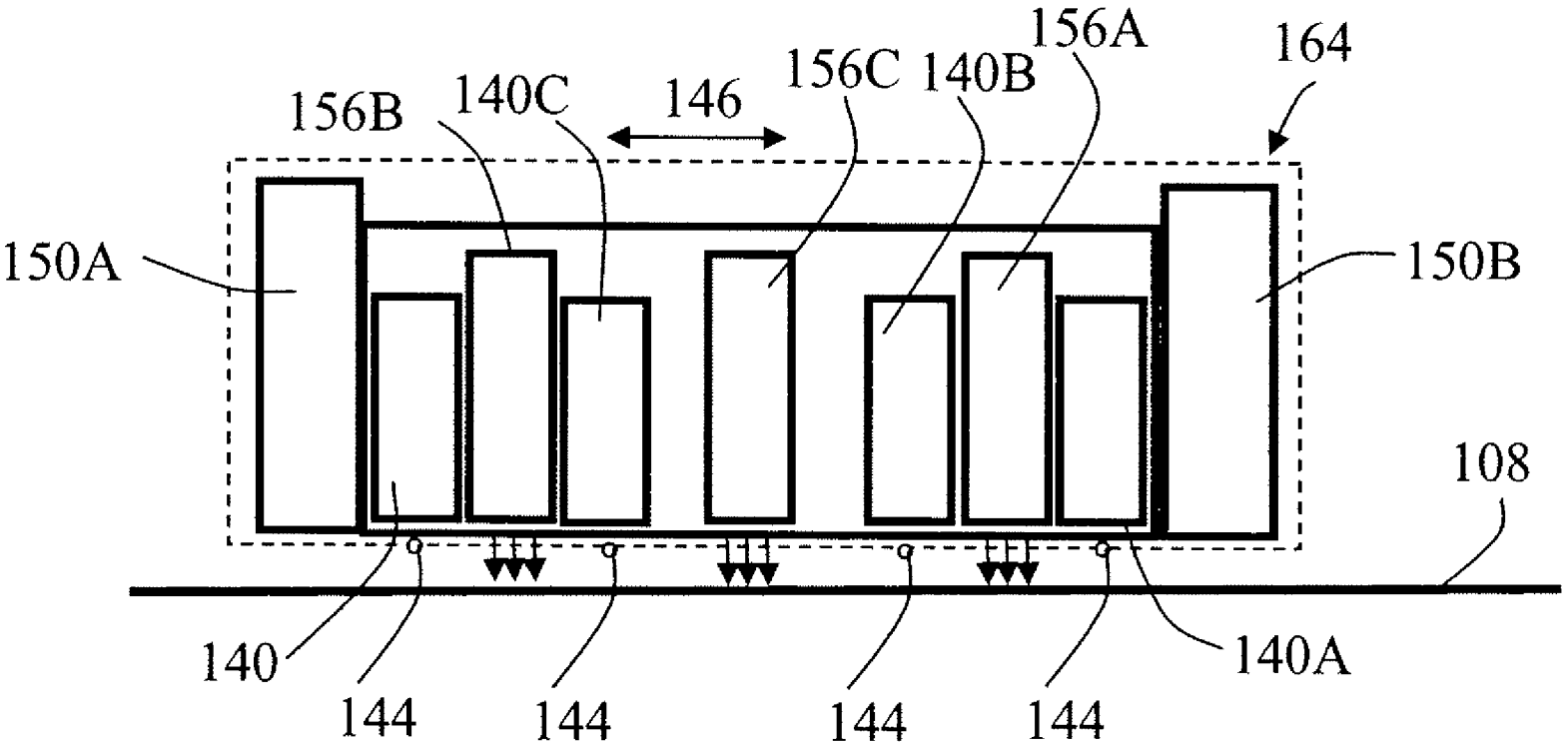
FIG. 3 is a schematic illustration of a carriage of another exemplary embodiment of an inkjet printer operating with a plasma substrate treatment unit.

FIG. 3 is a schematic illustration of an additional exemplary embodiment of carriage block 164 for use in an inkjet printer operating with a plasma substrate treatment unit. Plasma treatment unit 156A is between print heads 140A and 140B, plasma treatment unit 156B is between print heads 140C and 140D, and plasma treatment unit 156C is between print heads 140B and 140C. The print heads and plasma treatment units are between first and second UV sources 150A and 150B. Plasma units 156, print heads 140 and UV sources 150 are mounted on a carriage 164 arranged to reciprocate over substrate 108 as indicated by arrow 146. The print heads deposit ink droplets 144 on substrate the 108. The arrangement of plasma sources 156 disposed between print heads 140 allows a more thorough surface treatment. In an embodiment, the plasma sources 156A and 156B operate continuously and, as the carriage reciprocates, the leading plasma source pre-treats the substrate and the trailing plasma source post-treats the substrate and the deposited ink. Whilst the print head 140A precedes the plasma source 156A when the carriage is moving right wards, in this example printing is performed by moving the print head at least twice over the same surface so even if there is absence of pretreatment by the plasma on a first pass, there is pretreatment with respect to subsequent passes.

Figure 4:
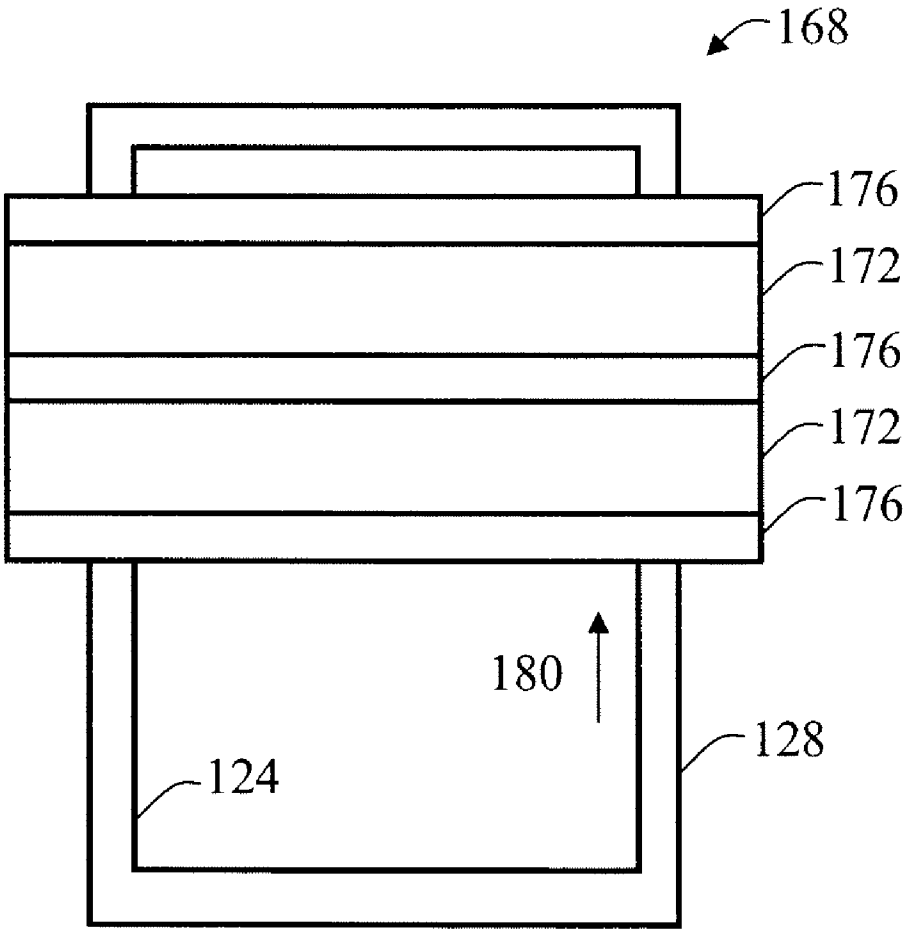
FIG. 4 is a schematic illustration of another exemplary embodiment of inkjet printer operating with a plasma substrate treatment unit.

FIG. 4 is a schematic illustration of another exemplary embodiment of an inkjet printer operating with a plasma substrate treatment unit. Printer 168 prints on substrate 124 with wide static print head arrays 172 which extend across at least the entire print area 124. Plasma sources 176 are located between print head arrays 172. The plasma sources extend across at least the entire print area 124. Bed 128 on which substrate 124 rests moves in the direction indicated by arrow 180. Plasma sources 176 provide post-printing surface treatment in addition to treatment of the substrate 124 before printing. Such treatment facilitates large format prints, such as billboards assembly, where in a large majority of the cases the newly printed images are glued over images already existing on the billboards and the glue adhesion to dried/cured ink is not sufficient.

Figure 5A:
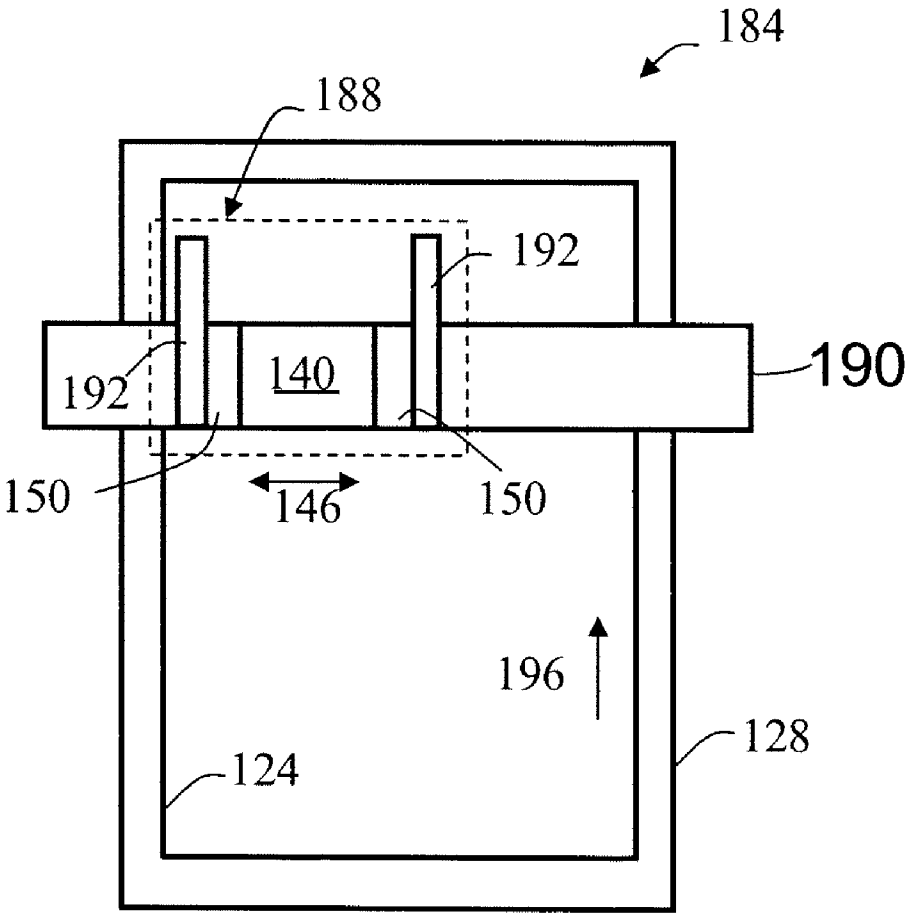
FIGS. 5A-5C are schematic illustrations of additional exemplary embodiments of an inkjet printer with a plasma substrate treatment unit.
Figure 5B:
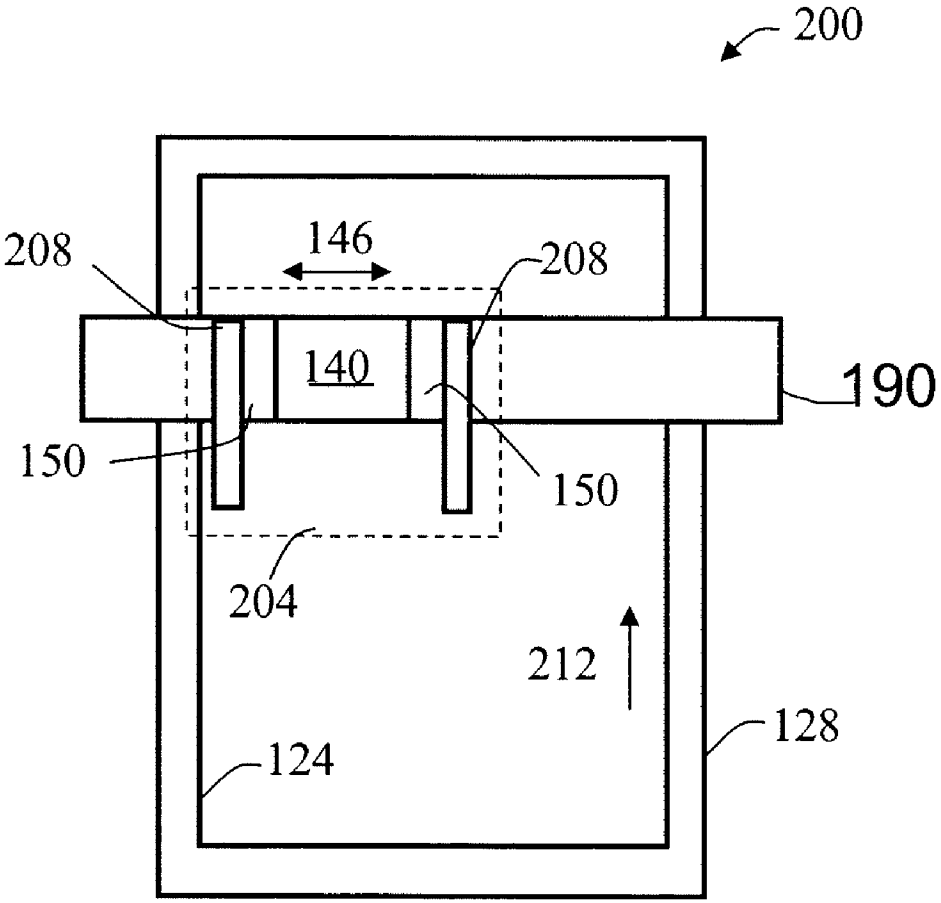
Figure 5C:
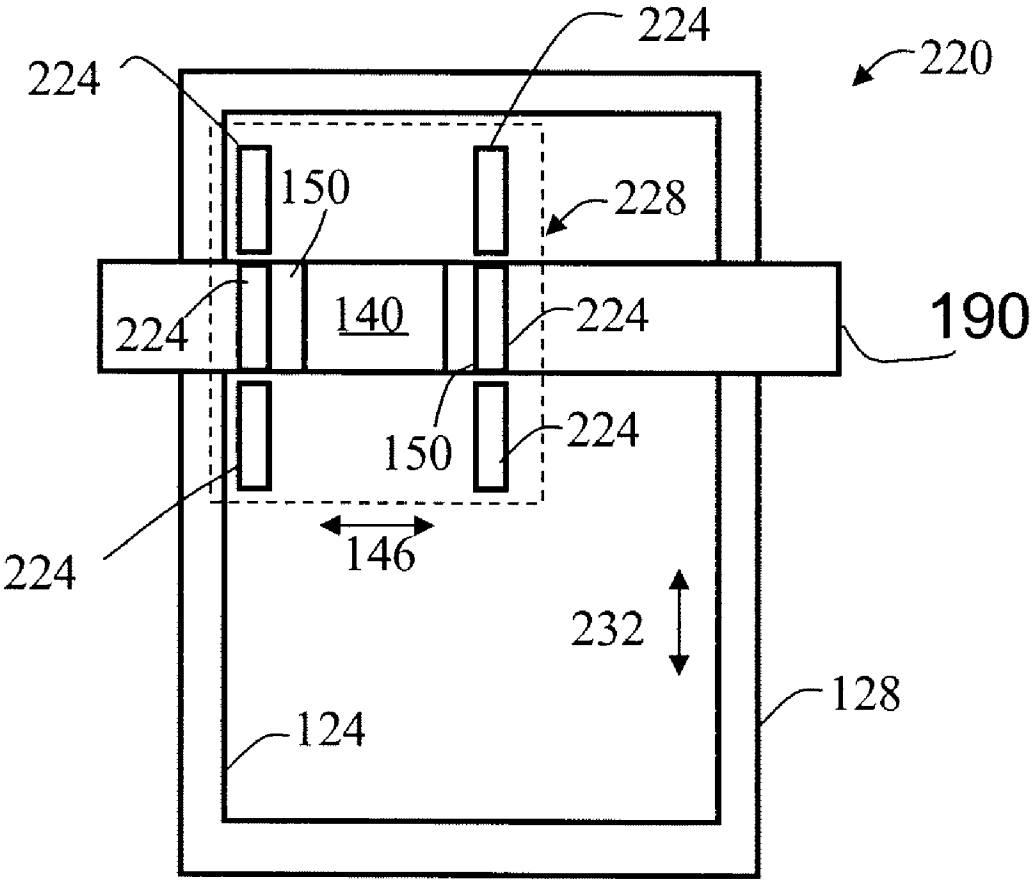

FIGS. 5A to 5C are schematic illustrations of additional exemplary embodiments of an inkjet printer with a source of plasma. Printer 184 (FIG. 5A) includes a carriage assembly 188 supported for movement in the direction 146 by a carriage support structure 190. The carriage has plasma sources 192 extending from it so as to provide to substrate 124 post-printing treatment, which as explained above improves glue adhesion to dried/cured ink and facilitates billboard assembly. Arrow 196 shows the direction of movement of the printed substrate 124. Printer 200 (FIG. 5B) includes a carriage assembly 204 with plasma sources 208 extending such as to provide to substrate 124 extensive pre-treatment, which may be required for substrates characterized by poor adhesion for example, polypropylene, polystyrene, polycarbonate, and similar. Arrow 212 indicates substrate 124 travel direction.

FIG. 5C illustrates a printer 220, which includes a number of plasma treatment sources 224 assembled on carriage 228 such as to provide substrate 124 pre-treatment and post-print treatment, enabling as explained above printing on substrates with poor adhesion and facilitating the billboard assembly. The assembly of plasma sources 224 may be replaced by one sufficiently long plasma source (not shown). Arrow 228 shows substrate 124 movement direction. Generally, this configuration enables bi-directional printing.

Figure 6:
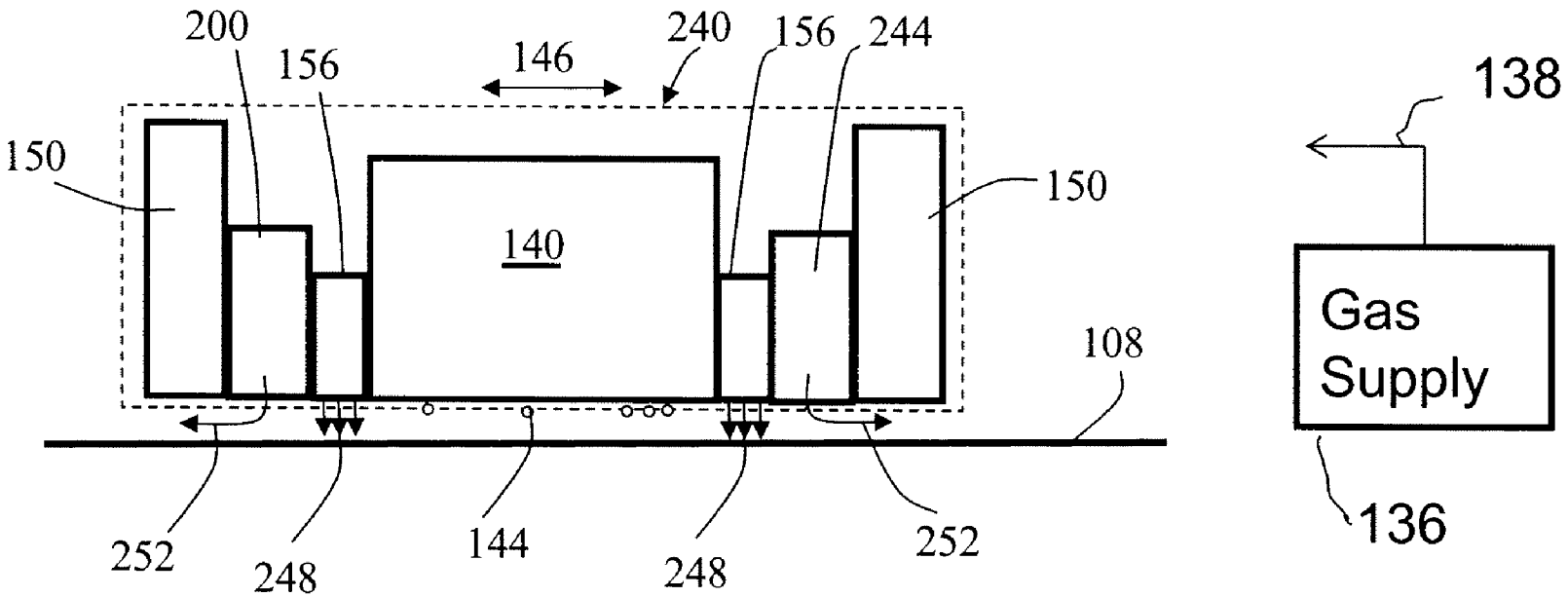
FIG. 6 is a schematic illustration of a carriage of a further exemplary embodiment of an inkjet printer with a source of plasma and a UV source coupled with an inert gas source.

The arrangements of FIGS. 5A to C also provide plasma treatment before printing and after printing in the direction of reciprocation of the carriage. In an embodiment, the plasma sources 224 each side of the print head operate continuously and, as the carriage reciprocates, the leading plasma source pre-treats the substrate and the trailing plasma source post-treats the substrate and the deposited ink The printers disclosed above which have a source of plasma and a UV source may also incorporate a dispenser of inert gas or a dispenser of oxygen depleted gas which introduces the gas between the UV source and the substrate to produce a layer of gas between the UV source(s) and the substrate which is at least depleted of oxygen. FIG. 6 is a schematic illustration of a further exemplary embodiment of an inkjet printer with a source of plasma and a UV source coupled with an inert gas supply 136. The carriage block 240 in addition to the earlier described print head 140, plasma source 156 and UV sources 150 may contain one or more gas dispensers 244. The dispensers 244 are connected to the gas supply 136 via a flexible pipe 138. The supply 136 supplies an inert gas for example nitrogen to the dispensers 244. Each dispenser is adjacent a UV source 150 and directs the gas to produce a layer at least depleted of oxygen between the source 150 and the substrate 108. Arrows 252 show inert gas flow direction and arrows 248 indicate plasma beam flow. The carriage block 240 may reciprocate over substrate 108 operating plasma sources 156 to treat surface of substrate 108, whilst the print head 140 deposits ink droplets 144 on substrate 108, the inert gas sources 200 provide an oxygen depleted atmosphere in the curing area, and the UV sources 150 operate to cure the printed ink. The oxygen depleted atmosphere reduces the UV energy required for ink curing.

The UV sources 150 mentioned above may be: at least one UV lamp which may have a hot or a cold mirror for concentrating and directing UV radiation. A hot mirror reflects heat to the substrate; a cold mirror allows heat to pass through the mirror without substantial reflection of heat towards the substrate. The UV sources 150 may be or a one-dimensional array, or two-dimensional array, or a three dimensional array of LEDs operable to emit a suitable wavelength. The, or each, array may have one or more radiation directing and concentrating elements.

The source of plasma 156 is an atmospheric or open source of plasma such as commercially available from Enercon Industries, Menomonee Falls, Wis. U.S.A., or Plasmatreat North America Inc. Mississauga, ON Canada.

In addition to the desired treatment effects, a plasma beam may heat substrate 108. In order to avoid this, or to maintain a suitable substrate temperature, substrate 108 may be cooled.

Plasma beam sources may be of any known type and provide the plasma beam through a slit type opening or a number of cylindrical tube-like channels. When the plasma beam/s is provided through a number of channels, they should be arranged such as to create an overlap of plasma covered sections of the substrate. Certain substrates may require more intense plasma surface treatment. In such cases, the plasma-providing unit may have a plasma concentrating facility.

The method of printing with printer 100, 120 or 130 of FIG. 1A, B or C will be explained now. (The printing and drying/curing processes with other disclosed printers are similar.) Printer 100, 120 or 130 prints with regular solvent based ink such as HP DR 100 Supreme or HP DR 200, or UV curable ink such as HP UV 100 Supreme or UV 200 Supreme. Carriage 132 with print head 136 and at least plasma source 156 moves over substrate 108 or 124. Plasma sources 156 generate a flow of ions that bombard the surface of substrate 108 or 124 and convert the substrate surface from a non-polar state to a polar state. Oxygen molecules present in the plasma are then free to bond to the ends of the molecules in the substrate being treated, resulting in an increase in surface tension. This increased cross-linking activity results in increased etchings on the substrate's surface, and stronger bonding attributes across surface of substrate 108 or 124.

Print head 140 deposits a swath of ink droplets 144 in an image wise manner on the treated section of substrate 108 or 124 following which the substrate is advanced. Upon completion of printing in case of solvent or water based ink substrate 108 or 124 is translated to a drying station 170 (FIG. 1C) that dries the printed ink. (As known in the art drying may take place simultaneous with printing.) When printing is performed with UV curable inks, the UV radiation sources 150 are operative to cure the printed ink. The plasma source treats surface of substrate 108 or 124 and any already cured or dried ink droplets 144 deposited at an earlier printing pass. The treatment improves the wettability and adhesion of the ink to both printing surface and earlier printed and dried or cured ink surface generating a relatively uniform with respect to printing conditions surface for the next printing pass.

The improved surface wettability supports ink droplets expansion on the printed surface and provides better surface coverage. Increased surface by ink coverage expands color gamut and reduces gloss related banding. Repeated treatment of each successive strip improves mechanical properties of ink deposited on the substrate. All of the above-mentioned benefits allow for a significant relief on the ink development process.

When relatively low UV radiation power sources such as LEDs are used or printing is performed on a heat sensitive substrate, inert gas or oxygen depleted gas may be introduced between the substrate and the UV sources. For example the embodiment of FIG. 6 may be used. According to this embodiment, inert gas flow as shown by arrows 252 is introduced under the UV sources 150 generating an oxygen-depleted layer. Almost simultaneously with the source of inert gas becoming operative the UV curing sources 150 become operative. The oxygen depleted layer located over non-cured ink reduces the effect of oxygen on the ink. UV curable ink may be reactive to oxygen and when exposed to oxygen become less sensitive to curing by the UV radiation. In an example the oxygen depleted layer located over non-cured ink reduces by about ten times the UV power required to cure printed ink droplets 144. and allows significant reduction of the UV power required for ink curing. Alternatively, it allows reduction in the UV lamp power and an increase in printing speed.

Open-air plasma operates at voltages of an order of magnitude lower that the voltage required by corona treatment. It results in a more uniform than corona surface treatment and the treated surface retains its properties for a period of time longer than corona treated surfaces. Substrate thickness does not affect the plasma treatment results. Plasma treats equally woven and non-woven substrates. Plasma cleans surface, improves wettability, and creates a type of micro-roughness enhancing ink adhesion. Mechanical properties of the ink are improved and color gamut expanded.

The disclosed above printing methods using plasma treatment and, in some embodiments UV curing which may also involve the use of inert or oxygen depleted gas supporting low power UV curing, may be used on a regular offset press with an inkjet print head or an array of print heads to treat hard to print surface and cure varnish deposited by inkjet print heads.

The use of plasma treatment improves surface qualities and expands the range of materials on which successful inkjet printing may be performed. Reduction in the power of the curing radiation sources allows an increase in the printer throughput. It also allows use of lower power UV sources further reducing the cost of the printer and increasing printing profitability.

The above described embodiments of FIGS. 1 to 3 and 5 to 6 have a carriage carrying at least a print head and a plasma source. Some versions also have at least one UV source and some additionally have at least one gas dispenser. The arrangement of the at least the print head and plasma source on the carriage provides a compact arrangement and allows plasma treatment to take place whilst printing occurs. In the embodiments plasma sources are arranged to treat the substrate both before printing and after printing or after printing and curing. Treating the substrate whilst printing takes place as described above improves the printing quality, the repeatability of print quality, and the stability of the printing.

Whilst the foregoing description refers to depositing ink on a substrate using an ink jet print head, the invention is not limited to depositing ink. It may be used to apply other material for example varnish. Such deposition is referred to as printing herein.

What is claimed is:

1. A printing apparatus comprising:

a first support for supporting a carriage, said carriage comprising a print head, a first plasma source, a second plasma source, a first ultraviolet (UV) source, and a second UV source;

wherein said first plasma source and said first UV source are provided on one side of said print head and said second plasma source and said second UV source are provided on an opposing side of said print head; and as said carriage moves relative to a print substrate in a first direction, said first plasma source pre-treats said print substrate with plasma before ink is deposited by said print head, and said second UV source cures said ink; and as said carriage moves relative to the print substrate in a second direction opposite to said first direction, said second plasma source pre-treats said print substrate with plasma before ink is deposited by said print head, and said first UV source cures said ink.

2. The printing apparatus according to claim 1, further comprising a source of gas which is inert or at least depleted of oxygen, the carriage carrying a gas dispenser for delivering the gas between at least one of the first and second UV sources and the print substrate.

3. The printing apparatus according to claim 1, further comprising a system for solidifying the deposited ink.

4. The printing apparatus according to claim 3, wherein the system for solidifying ink comprises an ink drying system.

5. The printing apparatus according to claim 4, wherein the ink drying system is located at a drying station spaced from a second support for the substrate.

6. Apparatus according to claim 4, wherein the drying system is arranged to operate simultaneously with the deposition of ink on the substrate.

7. The printing apparatus according to claim 1, further comprising first and second gas dispensers carried by the carriage and arranged to direct gas between the UV sources and the substrate.

8. The printing apparatus of claim 1 wherein, as said carriage moves relative to the print substrate in said first direction, the second plasma source post-treats said substrate and deposited ink.

9. The printing apparatus of claim 8 wherein, as said carriage moves relative to the print substrate in said second direction, the first plasma source post-treats said substrate and deposited ink.

10. The printing apparatus of claim 1 further comprising a second support for supporting the print substrate.

11. The printing apparatus according to claim 10, wherein the first and second supports are moveable relative to each other in two orthogonal directions.

12. The printing apparatus according to claim 11, wherein the first support is moveable in one of the said directions and the second support is moveable in the other of the two directions.

13. A method, comprising:

moving in a first direction a print carriage comprising a print head, a first plasma source, a second plasma source, a first ultraviolet (UV) source, and a second UV source with the first plasma source and first UV source provided on one side of the print head and the second plasma source and second UV source provided on an opposing side of the print head, said movement of the print carriage being relative to a print substrate;

as the print carriage moves in the first direction, pre-treating the print substrate with the first plasma source before ink is deposited by the print head and curing the ink by the second UV source after the print head deposits the ink;

moving the print carriage in a second direction opposite the first direction; and as the print carriage moves in the second direction, pre-treating the print substrate with the second plasma source before ink is deposited by the print head and curing the ink by the first UV source after the print head deposits the ink.

14. The method of claim 13 further comprising, as the print carriage moves relative in the first direction, post-treating the print substrate and deposited ink with the second plasma source.

15. The method of claim 14 further comprising, as the print carriage moves relative in the second direction, post-treating the print substrate and deposited ink with the first plasma source.

16. The method of claim 13 further comprising drying the ink.

17. The method of claim 13 further comprising delivering an inert or oxygen-depleted gas between at least one UV source and the print substrate.

* * * * *